US008858367B2

(12) United States Patent
Brun

(10) Patent No.: US 8,858,367 B2
(45) Date of Patent: Oct. 14, 2014

(54) GOLF SWING PRACTICE TARGET DEVICE

(71) Applicant: Paul Brun, Grand Barachois (CA)

(72) Inventor: Paul Brun, Grand Barachois (CA)

( * ) Notice: Subject to any disclaimer, the term of this patent is extended or adjusted under 35 U.S.C. 154(b) by 0 days.

(21) Appl. No.: 14/091,715

(22) Filed: Nov. 27, 2013

(65) Prior Publication Data

US 2014/0155189 A1 Jun. 5, 2014

Related U.S. Application Data

(60) Provisional application No. 61/732,479, filed on Dec. 3, 2012.

(51) Int. Cl.
*A63B 57/00* (2006.01)
*A63B 69/36* (2006.01)

(52) U.S. Cl.
CPC ..... *A63B 69/3655* (2013.01); *A63B 69/3661* (2013.01)
USPC ..... 473/396; 473/278; 473/387

(58) Field of Classification Search
USPC ..... 473/139, 150, 154, 173, 174, 188, 193, 473/219, 229, 231, 278, 279, 387, 392, 422, 473/396
See application file for complete search history.

(56) References Cited

U.S. PATENT DOCUMENTS

| | | | | | |
|---|---|---|---|---|---|
| 1,191,444 | A | | 7/1916 | Lott | |
| 1,363,446 | A | * | 12/1920 | Vogel | 473/139 |
| 1,427,638 | A | * | 8/1922 | Rhoades | 139/267 |
| 1,733,767 | A | | 10/1929 | Yaggi | |
| 1,753,654 | A | | 4/1930 | Hanson | |
| 1,784,363 | A | | 12/1930 | Lester | |
| 1,181,991 | A | | 10/1932 | Yaggi | |
| 1,881,991 | A | * | 10/1932 | Yaggi | 473/139 |
| 1,979,795 | A | | 11/1934 | Clark | |
| 2,490,409 | A | | 12/1949 | Brown | |
| 3,790,176 | A | * | 2/1974 | Rietz | 473/265 |
| 5,451,059 | A | * | 9/1995 | Weis | 473/146 |
| 6,569,026 | B1 | * | 5/2003 | Weis | 473/139 |
| 7,037,218 | B2 | | 5/2006 | Lubosco et al. | |
| 7,828,677 | B2 | * | 11/2010 | Steinhobel | 473/387 |
| 2006/0287135 | A1 | * | 12/2006 | Pommereau | 473/387 |

* cited by examiner

*Primary Examiner* — Nini Legesse
(74) *Attorney, Agent, or Firm* — Ryan W. Dupuis; Kyle R. Satlerthwaite; Ade & Company Inc.

(57) ABSTRACT

A reusable target device is used on with a golf swing practice mat having a teeing aperture formed therein to take the place of the collapsible tee conventionally used for teeing a practice golf ball thereon. The target device has i) a base flange portion received below the practice mat, ii) a stem portion extending upwardly from the base flange portion through the teeing aperture in the practice mat, and iii) a target portion supported at the top of the stem portion to simulate a golf ball to be struck during a practice swing. The base flange portion, the stem portion and the target portion are integrally and seamlessly formed with one another of a resilient material with a hollow passage arranged to be externally vented and collapsed upon impact by a swinging golf club.

20 Claims, 4 Drawing Sheets

GOLF SWING PRACTICE TARGET DEVICE

This application claims the benefit under 35 U.S.C. 119(e) of U.S. provisional application Ser. No. 61/732,479, filed Dec. 3, 2012.

FIELD OF THE INVENTION

The present invention relates to a target device for use in practicing a golf swing, and more particularly the present invention relates to a target device for use with a practice mat having a teeing aperture in which the target device includes a base portion to be received below the mat, a stem portion to extend upwardly through the teeing aperture in the mat, and a target portion for striking with the head of a golf club during a practice swing.

BACKGROUND

Golf is a popular recreational sport and various devices are known in the prior art to assist users in practicing their golf swing when not playing on a traditional golf course. The most common practicing method is to practice hitting balls from an artificial tee on a practice mat at a driving range for example. Driving ranges however typically require considerable space and management of a large number of golf balls to be repeatedly teed by a user practicing a golf swing. To minimize the repetitive teeing of golf balls and the management of a large number of golf balls to be collected, it is known to simulate a golf ball by providing a target device which is contacted by a golf club during a practice golf swing instead of contacting a golf ball. Various such target devices for practicing golf swings are disclosed in the following U.S. Pat. No. 5,451,059 by Weis, U.S. Pat. No. 1,979,795 by Clark, U.S. Pat. No. 6,569,026 by Weis, U.S. Pat. No. 7,037,218 by Lubosco et al., U.S. Pat. No. 2,490,409 by Brown, U.S. Pat. No. 1,881,991 by Yaggi, U.S. Pat. No. 1,784,363 by Lester, U.S. Pat. No. 1,753,654 by Hanson, U.S. Pat. No. 1,733,767 by Yaggi, U.S. Pat. No. 1,363,446 by Vogel, and U.S. Pat. No. 1,191,444 by Lott.

In all instances in the prior art the target to be contacted by the club head is either i) insufficient in mass or improperly configured to accurately represent striking a golf ball, or ii) alternatively if the target well represents a golf ball, the target is not sufficiently moveable once impacted by the club to represent the release of a golf ball from the club during an actual golf swing.

SUMMARY OF THE INVENTION

According to one aspect of the present invention there is provided a golf swing practice system comprising a target device in combination with a practice mat, the practice mat comprising a pad of resilient material arranged to be supported on a foundation and including a teeing aperture extending therethrough between opposing top and bottom sides of the practice mat, and the target device comprising:

a base flange portion arranged to be received between the practice mat and the foundation and spanning in a lateral direction by a width which is greater than the teeing aperture;

a stem portion extending upwardly from the base in a longitudinal direction so as to extend upwardly through the teeing aperture in the practice mat; and a target portion supported on the stem portion at a location spaced upwardly from the practice mat, the target portion having an increased lateral dimension in relation to the stem portion;

the base flange portion, the stem portion and the target portion being integrally and seamlessly formed with one another of a resilient material; and the stem portion including a hollow passage extending longitudinally therethrough which is externally vented such that the stem portion is readily collapsible under impact of a swinging golf club.

According to a second aspect of the invention there is provided a target device for use with a golf swing practice mat having a teeing aperture formed therein, the target device comprising:

a base flange portion arranged to be received below the practice mat;

a stem portion extending upwardly from the base in a longitudinal direction so as to be arranged to extend upwardly through the teeing aperture in the practice mat; and a target portion supported on the stem portion at a location spaced upwardly from the base flange, the target portion having an increased lateral dimension in relation to the stem portion;

the base flange portion, the stem portion and the target portion being integrally and seamlessly formed with one another of a resilient material; and the stem portion including a hollow passage extending longitudinally therethrough which is externally vented such that the stem portion is readily collapsible under impact of a swinging golf club.

By supporting the target on a hollow vented stem, the stem is sufficiently collapsible when striking with a golf club to better imitate the release of a golf ball from the club head when struck during a golf swing. Furthermore, the readily collapsible nature of the hollow vented stem allows the target to be better configured at simulating an actual golf ball to be struck by the club head as compared to prior art devices.

Preferably the hollow passage of the stem portion is externally vented adjacent a bottom end of the stem portion through an aperture in the base flange.

When the target portion is hollow, the target portion may be at least partially vented through the hollow passage of the stem portion, and/or may be at least partially vented through one or more vent apertures in the target portion. In this instance the target portion is arranged to be readily collapsible under impact of a swinging golf club.

Alternatively or in addition to the hollow portion, the target portion may include a solid core portion having a greater thickness than a wall thickness of the stem portion. The hollow portion may be provided in proximity to the solid core portion.

Preferably a largest cross sectional dimension of the solid core portion is equal to or less than a dimension of the stem portion transversely to the longitudinal direction.

The target portion may further include a plurality of flexible protruding members which protrude outwardly from the solid core portion such that an overall dimension of the target portion including the protruding members is greater than a dimension of the stem portion transversely to the longitudinal direction.

The target portion may yet further include an outer wall surrounding a hollow interior in which the outer wall has a striking portion of increased thickness arranged to be contacted by a swinging golf club.

When the target portion includes a hollow core portion and a plurality of flexible protruding members which protrude outwardly from the hollow core portion, preferably an overall dimension of the target portion including the protruding members is greater than a dimension of the stem portion transversely to the longitudinal direction.

Preferably the target portion is collapsible to a collapsed position in which a maximum dimension perpendicular to the longitudinal direction of the stem portion is equal to or less than a corresponding dimension of the stem portion to permit insertion through the teeing aperture in a practice mat. More particularly, when used with a practice mat, said maximum dimension is preferably equal to or less than a diameter of the teeing aperture in the practice mat.

Preferably the base flange extends radially outward from a bottom end of the stem portion about a full circumference of the stem portion.

The device may also be used in combination with at least one ground stake including a head portion and a ground penetrating portion arranged to be penetrated into the ground wherein the head portion is arranged to retain the base flange portion against the ground when the ground penetrating portion is penetrated into the ground.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
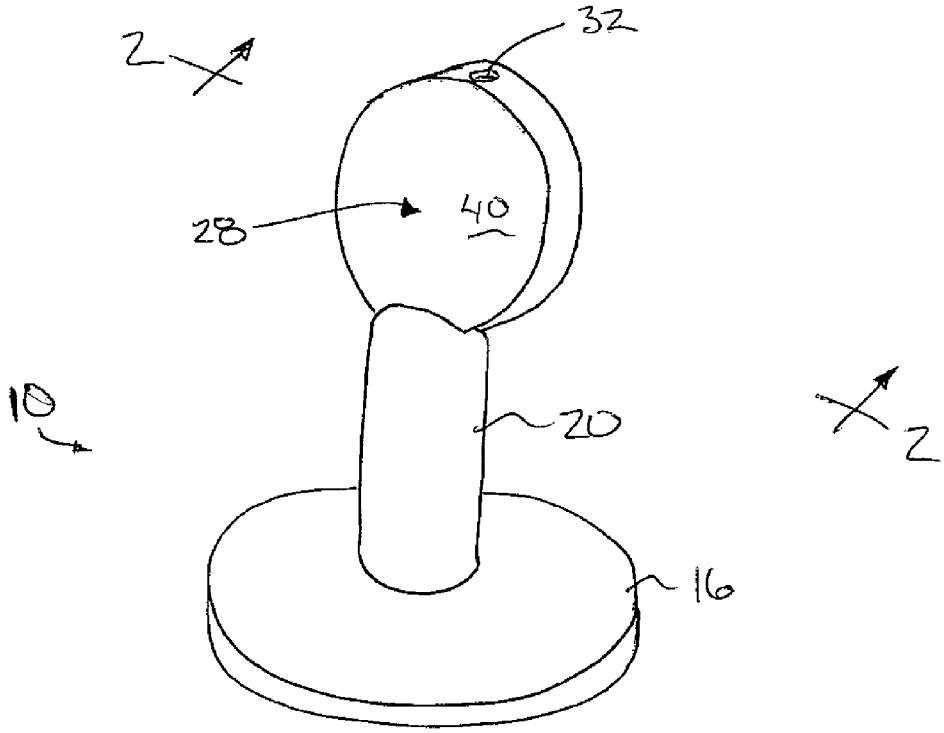
FIG. 1 is a perspective view of a first embodiment of the target device.

Referring to the accompanying figures, there is illustrated a golf swing practice target device generally indicated by reference numeral 10. The device 10 is preferred for use with a golf swing practice mat 12 in which the mat typically comprises a flat resilient pad which may support a layer of artificial turf 14 on an upper surface thereof. The mat further includes a teeing aperture 16 at a generally central location typically offset towards one end of the mat. The teeing aperture is a round aperture having a diameter of less than one inch for receiving various forms of reusable golf teeing devices therethrough.

Although various embodiments of the target device are described and illustrated in the accompanying specification, the common features of the various embodiments will first be described.

In each instance, the device 10 generally includes a base flange 16 in the form of a flat circular disk of resilient material having a diameter which is much larger than the teeing aperture. The base flange is intended to be supported below the practice mat 12 between the mat and a foundation 18 therebelow upon which the mat is supported, for example the ground.

The device further includes a stem 20 in the form of a hollow tube of resilient material which is concentrically supported integrally on the base flange to extend vertically upward perpendicularly to the base flange. The hollow tube is circular in a cross-sectional plane parallel to the base flange. The central location of the stem relative to the base flange ensures that the base flange extends radially outward from the bottom end of the stem in all directions about the full circumference thereof. The stem is elongate in a vertical and longitudinal direction extending upward from the base flange.

A hollow passage 24 extends longitudinally through the stem in communication through a central aperture 26 in the base flange 16 such that the hollow interior of the stem is vented through the aperture in the base flange at the bottom end of the stem. The diameter of the stem 20 is approximately equal to or only slightly less than the diameter of the teeing aperture in the mat 12. If the stem is of a shape other than being round, the maximum dimension of the cross section of the stem in a direction perpendicular to the longitudinal direction of the stem remains equal to or less than the diameter of the teeing aperture 16.

The target device further includes a target portion 28 formed of the same resilient material as the stem and the base flange such that all three portions are seamlessly and integrally molded with one another of a single, unitary and resilient material. The target portion has an increased dimension in a lateral direction perpendicular to the longitudinal direction of the stem in relation to the corresponding diameter of the stem with an overall shape which is generally circular or spherical to visually represent a golf ball supported on a tee.

The target portion remains collapsible such that it can be reduced in size by flexing the resilient material into a collapsed position in which a maximum dimension of the target portion in a direction perpendicular to the longitudinal direction of the stem is equal to or less than the diameters of the stem portion or the teeing aperture. In this instance, the target portion can be collapsed and inserted upwardly through the teeing aperture in the practice mat such that the base flange can be located below the mat while the stem portion extends upwardly through the teeing aperture to locate the target portion 28 at the top end of the stem spaced above the mat. The collapsibility of the target portion and the stem also aids in imitating the release of a ball from a golf club when impacted by a swinging club.

Turning now more particularly to the embodiments in FIGS. 1 through 6, at least a portion of the target portion 28 in these instances includes a hollow portion 30 comprising a hollow interior surrounded by outer walls with the hollow interior being vented externally so that the resilient walls about the hollow portion can be collapsed inwardly by venting when impacted by a swinging golf club. Venting of the hollow portion is accomplished by either one of or both of: i) communicating with the hollow passage of the stem to vent through the stem, or ii) communicating with one or more vent apertures 32 in the outer wall of the target portion 28.

Figure 8:
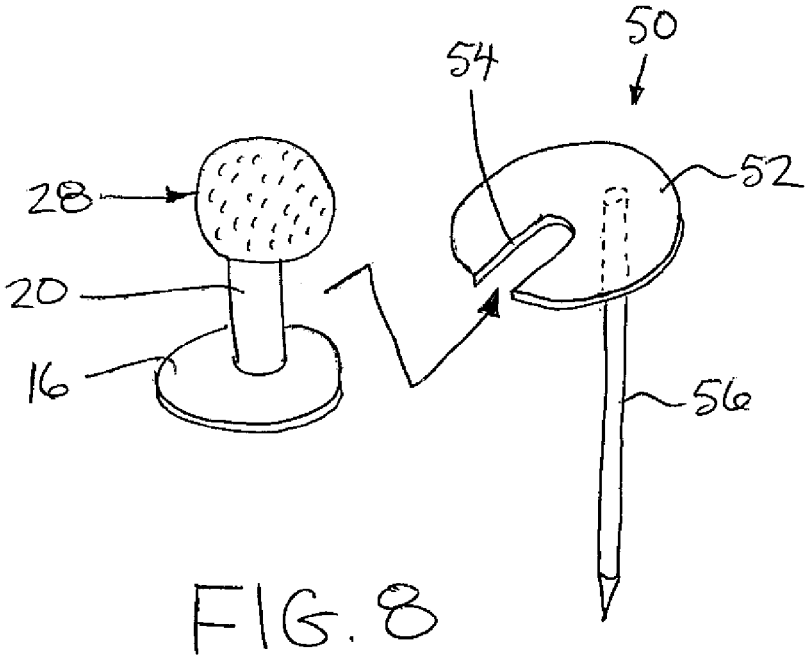
FIG. 8 is a perspective view of a preferred embodiment of the target device in combination with a ground stake for securing the target device against the ground when no practice mat is available.

In a preferred embodiment of FIG. 8, the target portion 28 consists only of the hollow portion 30 which includes a spherical outer wall of diameter corresponding to an actual golf ball. The outer surface may be dimpled to further resemble an actual golf ball. The hollow interior is vented through the hollow stem in this instance.

Figure 5:
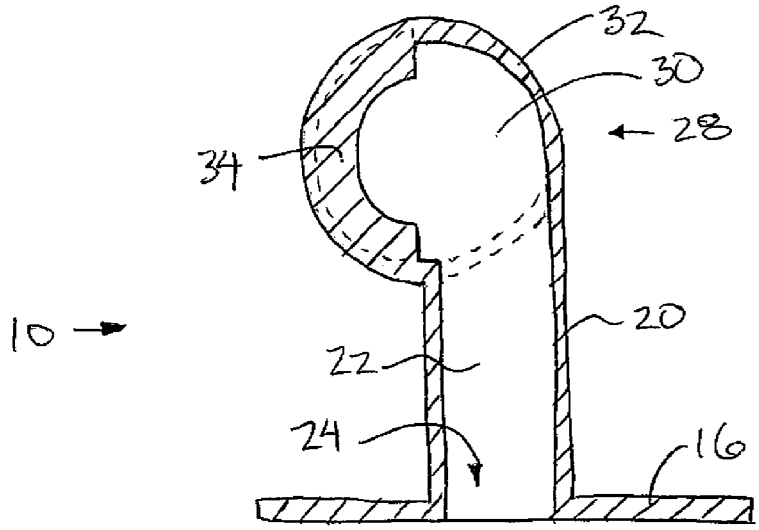
FIG. 5 is a vertical cross section of a fourth embodiment of the target device.
Figure 6:
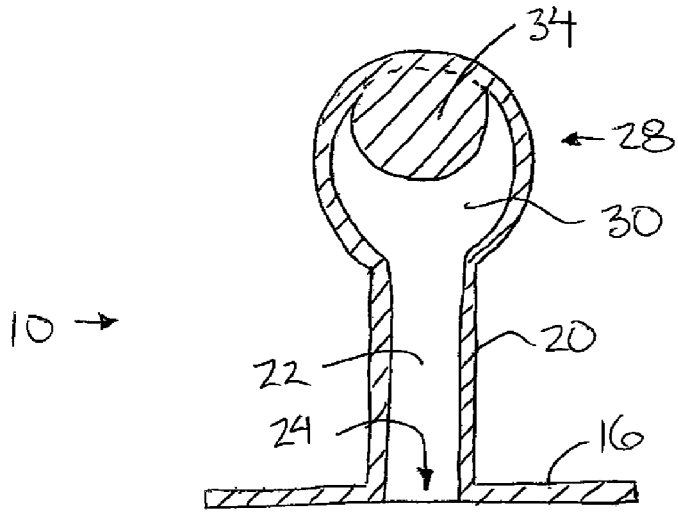
FIG. 6 is a partly-sectional view of a fifth embodiment of the target device.
Figure 7:
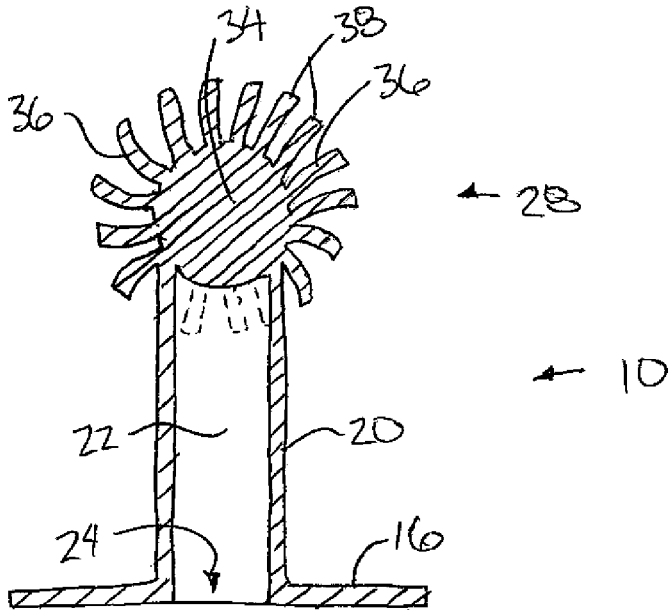
FIG. 7 is a partly-sectional view of a sixth embodiment of the target device.

Turning now to FIGS. 5 through 7, in these instances, the target portions 28 also include a solid core portion 34 in which a solid mass of material is provided with an overall dimension or thickness which is much greater than the wall thickness of the stem about the hollow passage thereof or of any outer walls about a hollow portion of the target portion if present. The solid core portion is thus less compressible and collapsible than the remainder of the target or stem portion. The solid core portion only represents a minor portion of the overall target device however as in each instance a remaining portion of the target 28 remains collapsible about the solid core portion. In this instance, the maximum dimension of the solid core portion perpendicular to the longitudinal direction of the stem is equal to or slightly less than the diameter of the stem portion or teeing aperture such that when the remainder of the target is collapsible about the solid core, the target portion 28 retains its ability to be inserted upwardly through the teeing aperture in a practice mat.

Figure 4:
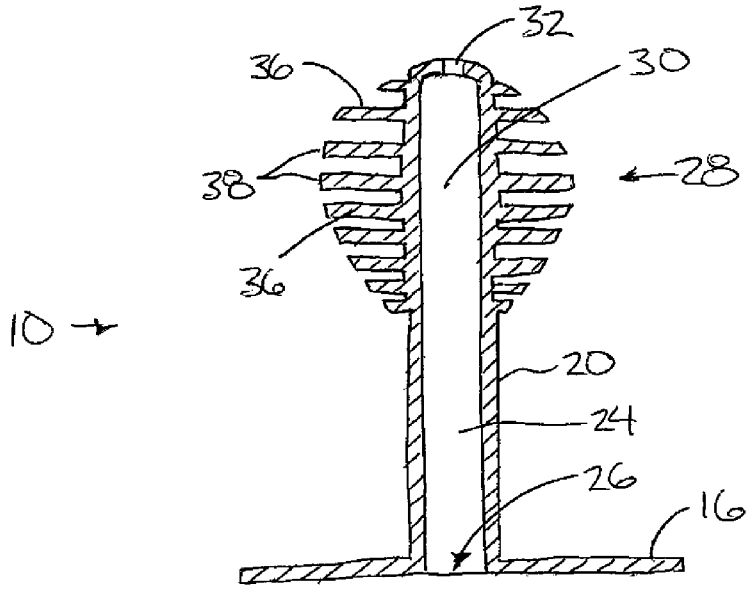
FIG. 4 is a vertical cross section of a third embodiment of a target device.

Turning now to FIGS. 4 and 7, the core portion which is either hollow or a solid core is further provided with a plurality of protruding members 36 in the form of elongate and flexible members of resilient material extending generally radially outward from the core about the full circumference thereof. The outer free ends 38 of the protruding members define an overall generally cylindrical or spherical outer shape with an overall diameter corresponding approximately to the diameter of a golf ball so as to be much greater than the diameter of the stem portion or the teeing aperture to better visually represent a golf ball while remaining sufficiently collapsible to be inserted upwardly through a teeing aperture in a practice mat.

Figure 2:
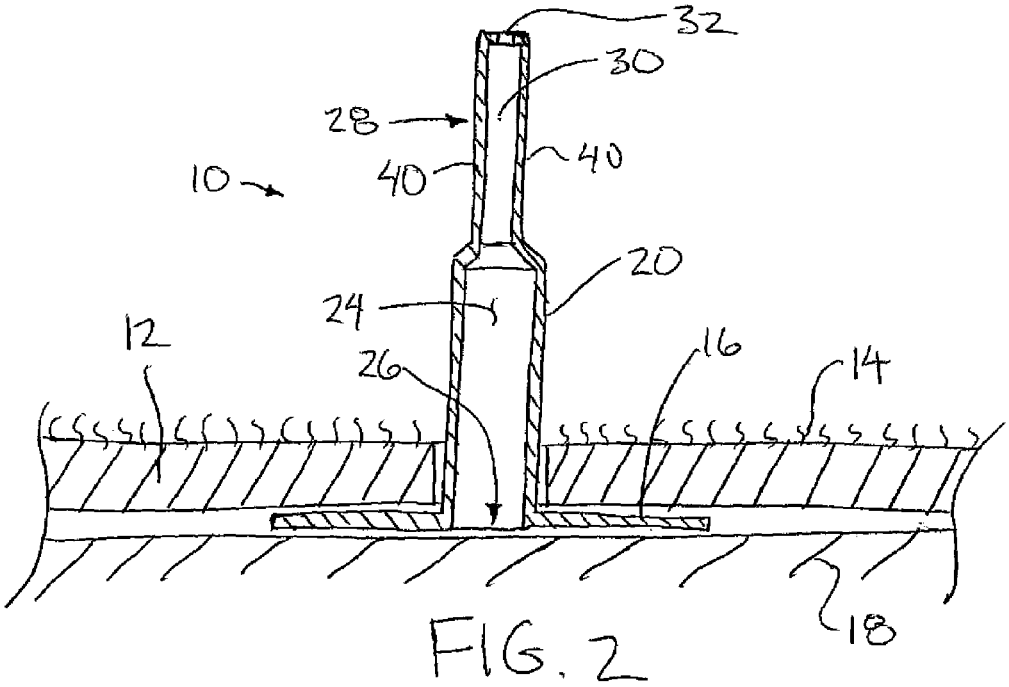
FIG. 2 is a sectional view of the target device according to FIG. 1 shown in use with a practice mat to collectively define a golf swing practice system.

Turning now more specifically to the embodiment of FIG. 2, the target portion in this instance comprises two flat and circular outer side walls 40 which are parallel and spaced apart and joined to one another about their peripheral edges to define the outer walls about the hollow interior of the hollow portion 30. The diameter of the flat circular sides correspond to the diameter of a golf ball. The thickness of the outer walls about the hollow interior in this instance are substantially identical to the thickness of the outer wall of the stem 20 about the hollow passage extending therethrough. The hollow interior of the hollow portion 30 in this instance openly communicates with the hollow passage of the stem to permit venting externally downwardly through the stem and through the aperture at the bottom end at the base flange.

Figure 3:
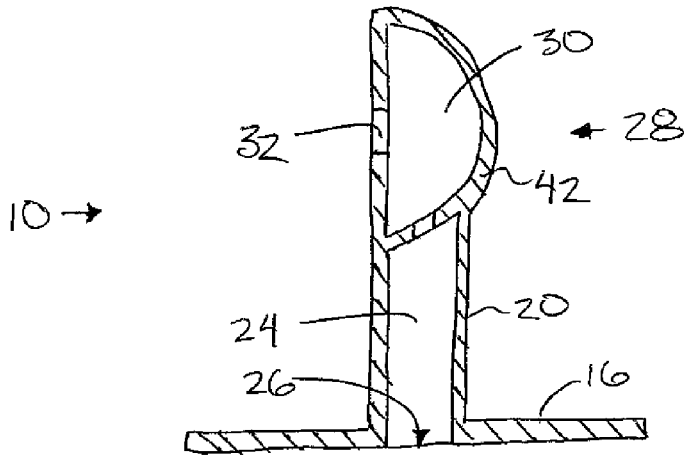
FIG. 3 is a vertical cross section of a second embodiment of the target device.

As shown more particularly in FIG. 3, the target in this instance may comprise an outer wall 42 which is semi-spherical in shape with a wall thickness which is substantially equal to the stem portion. A wall portion may be provided between the hollow portion of the target portion 28 and the stem 20 such that the stem in this instance may be vented only through the bottom side while one or more vent apertures 32 in the target portion permit the venting of the hollow portion of the target. Alternatively an additional vent hole may be provided to communicate through the wall between the hollow portion of the target and the hollow passage of the stem that the stem can additionally be vented upwardly through corresponding apertures in the target portion 28.

Turning now to the embodiment of FIG. 4, the hollow portion 30 in this instance comprises a cylindrical outer wall defining a hollow core which is continuous with the cylindrical outer wall of the stem portion to be concentrically aligned therewith and have similar diameter for open communication between the stem and the hollow portion of the target device. The vent aperture 32 and the target portion in this instance is centrally located at the top end of the hollow core of the target portion 28 for venting both the stem and the target portion upwardly through the top vent aperture. The larger mass of the target portion in this instance is defined solely by the protruding members 36 in the form of horizontal and annular flanges projecting radially outward from the hollow core about the full circumference thereof. The overall diameter of the annular protruding members varies from top to bottom such that the outer free ends 38 define an overall spherical shape corresponding approximately to the diameter of a golf ball.

Turning now to the embodiment of FIG. 5, in this instance the outer wall about the hollow portion 30 defines an outer surface which is generally spherical in shape however the wall thickness varies such that a thicker portion along one side of the spherical shape defines a denser solid core portion 34 which may be of similar or different material about which the remainder of the target device is integrally molded. A plurality of the vent apertures 32 are provided in this instance through the outer wall of the hollow portion and between the hollow portion of the target portion 28 and the hollow passage of the stem therebelow to allow venting in multiple directions.

As shown in FIG. 6, the outer wall of the hollow target portion may again define a generally spherical outer surface while the inside remains mostly hollow. The solid core portion 34 in this instance may be integrally formed with the top side of the spherical outer wall to locate the solid core portion at the upper most portion of the target device. The solid core portion may again simply be a thicker portion of the outer wall about the hollow interior or a denser material may be inserted into the mold used to form the resilient material into the remainder of the shape of the target device.

As shown in the embodiment of FIG. 7, the solid core portion 34 in this instance may comprise a spherical mass having the same diameter as the stem 20 while being located concentrically therewith at the top end of the stem. The protruding members 36 in this instance extend radially outward in all directions from the solid core portion so that the outer free ends define a round peripheral shape. At least one side of the solid core may be free of protrusions to define a striking face of the solid core which may be directly engaged by a swinging golf club by a practice swing.

Instead of use with a practice mat, in either of the embodiments noted above, the base flange may be provided with a pair of anchoring apertures at diametrically opposed locations relative to the stem portion for receiving ground stakes therein for direct anchoring to the ground. The two ground stakes typically would each be provided with a ground penetrating portion arranged to be received through the anchoring apertures respectively and a head portion which is enlarged relative to the ground penetrating portion to engage a top side of the base flange about the anchoring apertures and thereby retain the base flange against the ground.

Alternatively, as shown in FIG. 8, a single ground stake 50 may be provided for use of the target device without a practice mat. The ground stake 50 has a head portion 52 in the form of a flat plate with a slot 54 extending generally radially inwardly from the peripheral edge of the plate. The slot 54 has a width equal to the diameter of the stem portion 20 to receive the stem slidably therein in the radial direction of the plate so that the plate overlaps the top side of the base flange portion 16 of the target device in use. The stake 50 also includes a ground penetrating portion 56 arranged to be penetrated into the ground. The ground penetrating portion is an elongate rigid spike oriented to project perpendicularly from the bottom side of the plate towards a pointed bottom free end. The ground penetrating portion is spaced along the plate from the slot 54 by a distance corresponding to the radial dimension of the base flange portion 16 protruding from the stem portion 20 so that the stem portion can be abutted with the inner terminal end of the slot 54 without interference between the ground penetrating portion 56 and the base flange portion 16 in use.

The head portion is thus arranged to retain the base flange portion 16 against the ground when the ground penetrating portion is penetrated into the ground by effectively clamping the base flange portion 16 between the plate of the head portion 52 and the ground.

In general, in the various embodiments above, the air release from the hollow structure of the stem will be done through the hole at the bottom of the base or through one or more vent apertures in the target portion. In some instances to better simulate hitting of a golf ball, a solid core portion is inserted into the target portion. The solid piece could be a rigid material while remaining smaller than a golf ball so as to permit insertion upwardly through the teeing aperture in the practice mat. In either instance, the configuration of the target portion will not interfere with the collapsing and flattening of the stem portion to better imitate the release of a golf ball from the club head subsequent to impact.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A target device for use with a golf swing practice mat having a teeing aperture formed therein, the target device comprising:

a base flange portion arranged to be received below the practice mat;

a stem portion extending upwardly from the base in a longitudinal direction so as to be arranged to extend upwardly through the teeing aperture in the practice mat;

a target portion supported on the stem portion at a location spaced upwardly from the base flange, the target portion having an increased lateral dimension in relation to the stem portion;

the base flange portion, the stem portion and the target portion being integrally and seamlessly formed with one another of a resilient material; and a hollow passage located internally within the stem portion between the base flange portion and the target portion and extending in the longitudinal direction of the stem portion, the hollow passage being vented externally of the stem portion such that the hollow passage of the stem portion is readily collapsible under impact of a swinging golf club.

2. The device according to claim 1 wherein the hollow passage of the stem portion is externally vented adjacent a bottom end of the stem portion.

3. The device according to claim 1 wherein the hollow passage of the stem portion is externally vented at a bottom end of the stem portion through an aperture in the base flange.

4. The device according to claim 1 wherein the target portion is hollow.

5. The device according to claim 4 wherein the target portion is at least partially vented through the hollow passage of the stem portion.

6. The device according to claim 4 wherein the target portion is at least partially vented through at least one vent aperture in the target portion.

7. The device according to claim 6 wherein the target portion is vented through a plurality of apertures in the target portion.

8. The device according to claim 1 wherein the base flange extends radially outward from a bottom end of the stem portion about a full circumference of the stem portion.

9. The device according to claim 1 wherein target portion is arranged to be readily collapsible under impact of a swinging golf club.

10. The device according to claim 1 wherein the target portion includes a solid core portion having a greater thickness than a wall thickness of the stem portion.

11. The device according to claim 10 wherein a largest cross sectional dimension of the solid core portion is equal to or less than a dimension of the stem portion transversely to the longitudinal direction.

12. The device according to claim 10 wherein the target portion includes a hollow portion in proximity to the solid core portion.

13. The device according to claim 10 wherein the target portion includes a plurality of flexible protruding members which protrude outwardly from the solid core portion such that an overall dimension of the target portion including the protruding members is greater than a dimension of the stem portion transversely to the longitudinal direction.

14. The device according to claim 1 wherein the target portion includes an outer wall surrounding a hollow interior, the outer wall having a striking portion of increased thickness arranged to be contacted by a swinging golf club.

15. The device according to claim 1 wherein the target portion includes a hollow core portion and a plurality of flexible protruding members which protrude outwardly from the hollow core portion such that an overall dimension of the target portion including the protruding members is greater than a dimension of the stem portion transversely to the longitudinal direction.

16. The device according to claim 1 wherein the target portion is collapsible to a collapsed position in which a maximum dimension perpendicular to the longitudinal direction of the stem portion is equal to or less than a corresponding dimension of the stem portion.

17. The device according to claim 16 in combination with the practice mat wherein said maximum dimension is equal to or less than a diameter of the teeing aperture in the practice mat.

18. The device according to claim 1 in combination with the practice mat wherein a diameter of the stem portion is approximately equal to a diameter of the teeing aperture.

19. The device according to claim 1 in combination with at least one ground stake including a head portion and a ground penetrating portion arranged to be penetrated into the ground wherein the head portion is arranged to retain the base flange portion against the ground when the ground penetrating portion is penetrated into the ground.

20. A golf swing practice system comprising a target device in combination with a practice mat, the practice mat comprising a pad of resilient material arranged to be supported on a foundation and including a teeing aperture extending therethrough between opposing top and bottom sides of the practice mat, and the target device comprising:

a base flange portion arranged to be received between the practice mat and the foundation and spanning in a lateral direction by a width which is greater than the teeing aperture;

a stem portion extending upwardly from the base in a longitudinal direction so as to extend upwardly through the teeing aperture in the practice mat;

a target portion supported on the stem portion at a location spaced upwardly from the practice mat, the target portion having an increased lateral dimension in relation to the stem portion;

the base flange portion, the stem portion and the target portion being integrally and seamlessly formed with one another of a resilient material; and a hollow passage located internally within the stem portion between the base flange portion and the target portion and extending in the longitudinal direction of the stem portion, the hollow passage being vented externally of the stem portion such that the hollow passage of the stem portion is readily collapsible under impact of a swinging golf club.

* * * * *